US005153045A

United States Patent [19]

Löfgren

[11] Patent Number: 5,153,045

[45] Date of Patent: Oct. 6, 1992

[54] CAMOUFLAGE COVERING

[75] Inventor: Per-Åke Löfgren, Halmstad, Sweden

[73] Assignee: Diab-Barracuda AB, Laholm, Sweden

[21] Appl. No.: 473,989

[22] PCT Filed: Oct. 27, 1988

[86] PCT No.: PCT/SE88/00577

§ 371 Date: Apr. 17, 1990

§ 102(e) Date: Apr. 17, 1990

[87] PCT Pub. No.: WO89/03971

PCT Pub. Date: May 5, 1989

[30] Foreign Application Priority Data

Oct. 28, 1987 [SE] Sweden ..... 8704197-6

[51] Int. Cl.[5] ..... B32B 33/00; B32B 5/06; B32B 3/02; B32B 5/22

[52] U.S. Cl. ..... 428/95; 428/85; 428/91; 428/300; 428/919

[58] Field of Search ..... 428/85, 91, 95, 300, 428/919

[56] References Cited

U.S. PATENT DOCUMENTS

| | | | |
|---|---|---|---|
| 3,347,736 | 10/1967 | Sissons | 428/95 X |
| 3,822,173 | 7/1974 | Graber et al. | 428/300 X |
| 3,935,046 | 1/1976 | Kiernan et al. | 428/300 X |
| 4,096,302 | 6/1978 | Thibodeau et al. | 428/95 |
| 4,107,361 | 8/1978 | Parker | 428/17 |
| 4,199,635 | 4/1980 | Parker | 428/300 X |
| 4,287,243 | 9/1981 | Nielsen | 428/17 |
| 4,389,434 | 6/1983 | Polman | 428/17 |
| 4,622,253 | 11/1986 | Levy | 428/91 |
| 4,659,602 | 4/1987 | Birch | 428/88 |
| 4,767,649 | 8/1988 | Birch | 428/99 |
| 4,818,586 | 4/1989 | Smith et al. | 428/91 X |

FOREIGN PATENT DOCUMENTS

| | | |
|---|---|---|
| 0114154 | 7/1984 | European Pat. Off. . |
| 0123660 | 10/1984 | European Pat. Off. . |
| 0198283 | 10/1986 | European Pat. Off. . |
| 8703082 | 5/1987 | PCT Int'l Appl. . |
| 8801363 | 2/1988 | PCT Int'l Appl. . |
| 2078799 | 1/1982 | United Kingdom . |

*Primary Examiner*—George F. Lesmes
*Assistant Examiner*—Terrel Morris
*Attorney, Agent, or Firm*—Lee, Mann, Smith, McWilliams, Sweeney & Ohlson

[57] ABSTRACT

A camouflage covering intended for affixing to military objects, particularly heated surfaces of tanks. It consists of layers held together by means of neelding and comprises a super-absorbent fibers, so that it can be kept cool by evaporating water previously applied. By including fibers, it may have radar camouflage properties. A substantial pile obtained by needling will give a non-reflecting surface.

9 Claims, 1 Drawing Sheet

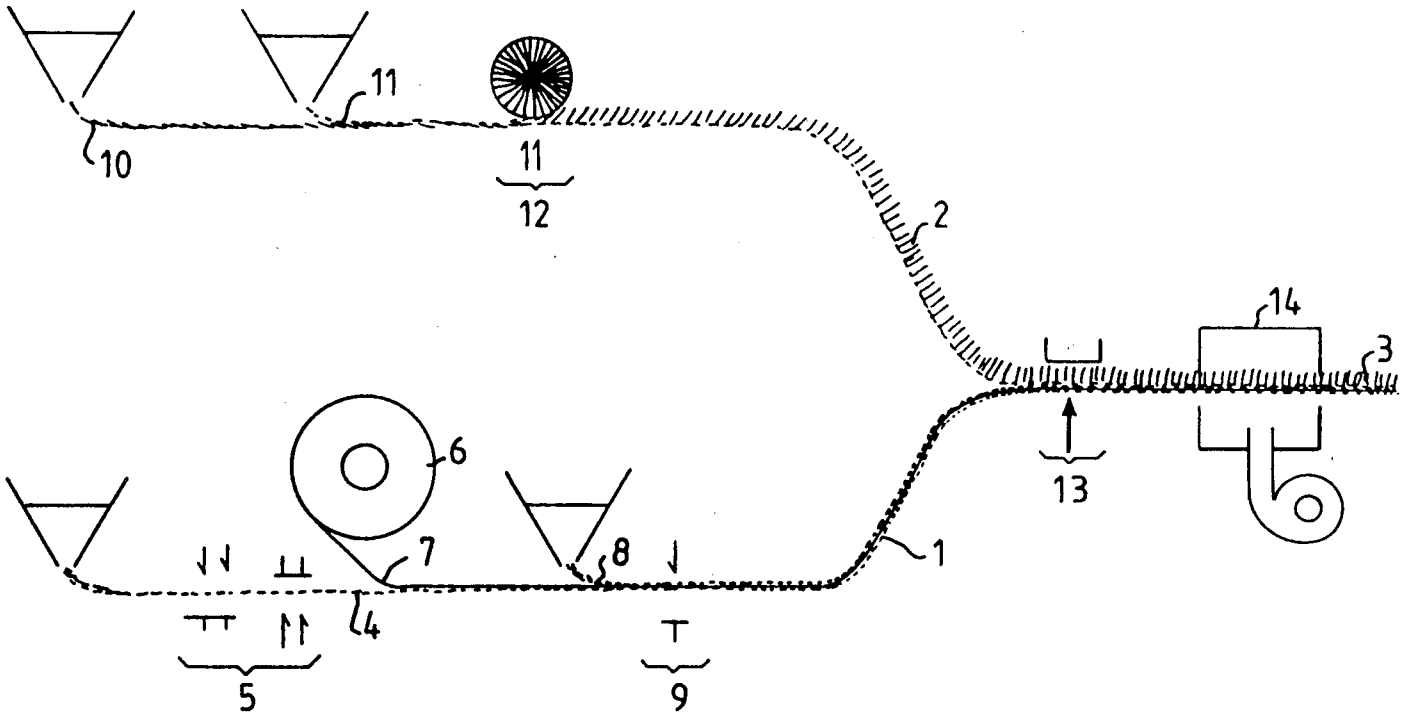
3
14
13
2
1
9
8
11
12
6
7
4
11
5
10

CAMOUFLAGE COVERING

The invention regards a camouflage covering which is intended for fixing on surfaces which are likely to be heated and therefore detectable by infrared reconnaissance. A particular use is for covering some or all surfaces of tanks.

It is known from U.S. Pat. No. 4,659,602 to apply mats of carpet type for this purpose. According to WO87/03082, it is also known to include in such a mat some yarn strands or natural wool, which will take up rain water or other applied moisture, which with atmospheric evaporation will give a lowered temperature signature.

It is an object of the present invention to obtain a camouflage covering having a carpet structure, and including good camouflage properties in the visible, and against radar reconnaissance, which combines particularly good IR camouflage properties and a non-prohibitive price.

According to the invention, such a mat-like camouflage covering is obtained by means of a judicious choice of layers which are bound together by means of appropriate needling methods, which are known per se in the carpeting industry.

For the purpose of explaining this invention, it may therefore be sufficient to remind that ordinary needling is made by sticking through a web of collected fibers with sets of needles, which on the other side pass through holes in a counterplate. Dilo needling is made by letting the needles pass through the web and end up in a brush.

According to the invention, a mat-like structure having the desired properties is obtained by needling together several webs of different materials, one of which comprises a so-called super-absorbent material. There exist several such materials, some of which have a very poor structure when wet, e.g. metoxycellulose. It is therefore preferred to use some such material which has better structural properties when wet, e.g. an acrylic-based fiber-like Lanseal, mixed with some fibers which further improve the structure, like rayon and/or polypropene.

It is advantageous to include in the structure some fibers which are hydrophilic, as this will improve evaporation from the layer comprising super-absorbent material. It is also advantageous to comprise in all the webs, or at least some, electrically conducting fibers, as this will give a good radar absorption property. The fact that the radar absorbency is distributed in a three-dimensional structure improves substantially the radar camouflage effect.

For obtaining a good visual camouflage effect, it is a particularly advantageous feature that the outermost pile of the camouflage covering is a Dilo-made pile, which substantially diminishes light reflexion properties.

In order to obtain a long-term effect of a wetted camouflage, it is advantageous to include near the bottom a reflecting layer comprising an aluminum foil or an aluminized web of plastic material. This will also improve the radar camouflage properties. Another advantageous feature is to add a bottom layer comprising much air, such as a net or a canal structure, which will give thermal insulation and/or a possibility of heat transport by convection traverse to the covering when situated vertically or near vertical.

The camouflage covering having the form of a web with a certain stiffness will have to be tailored in order to mount it, e.g. by means of adhesive. In order to cover e.g. surfaces with a double curvature, it may be partially cut up checker-wise, admitting a substantial conforming. It may also be affixed to a waffled web on the backside, in order to obtain thermal insulation.

The invention will be further understood by reference to an exemplary embodiment, the manufacture of which is visualized schematically in the FIGURE.

The Figure shows the various steps of manufacture of a camouflage covering according to the invention, by combining webs, most of them made from fibers in non-woven state. The making of webs of simply laid out fiber layers has been symbolized by simple hoppers, as the man of the art familiar with the manufacture of needle-felt and related textile structures will know how to make such layers. The Figure is also simplified in that several steps are shown as being performed at once, although naturally, in practice, there will be steps of storing on rolls between the various steps shown in the Figure.

As shown in the Figure, there is made a bottom portion 1 and a top portion 2, which are then laid together and fixed in order to obtain the final product 3.

To start the description with the bottom portion, a strength layer 4 is made by needling together from two sides at 5 of a layer of fibers. An aluminized plastic film 7 is laid on top from a roll 6, and a layer 8 comprising super-absorbent fibers is laid on top of the aluminized plastic film. The layers are then made to keep together by a slight needling operation at 9.

The top portion is obtained by laying two layers 10 and 11 of fibers one on top of the other. Those two layers are bound together by means of a Dilo needling device 12, in order to obtain the top portion web 2, having a typical pile structure reminding of pig's bristle.

The two composite webs 1 and 2 are then laid together and needled together from the underside with comparatively few needle stitches and broad needles, which are not permitted to pass into the "pig's bristle", which will thus retain its substantial surface structure. Finally, at 14, the composed product is drawn through a blowing oven, blowing hot air through the structure, which will at least partly melt some of the fibers having an inferior melting-point, such that an improved mechanical resistance is obtained.

EXAMPLE

A camouflage covering was manufactured, which had a total weight of about 1200 g/m$^2$.

1. A bottom layer was made by ordinary needling of a web of polyester fibers, about 300 g/m$^2$.

2. A layer of Mylar film, 20 g/m$^2$, covered on both sides with an aluminum layer, was laid on top of the bottom layer.

3. A web of super absorbent fibers of the acrylic-based type (Lanseal), 25% by weight, rayon fibers 20% by weight and polypropene fibers 55% by weight, was laid on top of the Mylar film. This sandwich was needled weakly from both sides, in order to obtain a reasonably consistent web.

4. A further web was made from two fiber layers, a top layer of "nature-colored" (green) polypropylene fibers and some 10% by weight of binding fibers K 140 (polyamide), 3% by weight of metal fibers, in total 150 g/m$^2$, and a bottom layer comprising more binding fibers K 140 (30% by weight). The two layers were needled together by Dilo needling from the underside, in order to obtain a consistent web having a good pile on the top side. The total weight of that combined web was 300 g/m$^2$.

5. The two layers were then laid together, with the Dilo-needling pile outward and the said bottom layer opposite thereto. The two layers were needled from the underside, whereby the needles were not permitted to pierce so far that their barb points could reach into the brushy Dilo-pile layer.

6. Finally, the composed covering was blown through in an oven with air at 145° C., thus obtaining good binding in the surface layer and good mechanical resistance.

In order to obtain the full advantages of a camouflage covering according to the invention, it should be wetted at intervals by sprinkling with water. It has been shown that this covering takes up water easily and will then keep a cool surface for a substantial period of time, and will in fact keep a surface temperature nearing the dew-point, being able to dissipate considerable heat by evaporation.

It is possible to include visual camouflage by varying the color in the surface layer, e.g. by laying pieces of black webs between the two layers which form the surface portion.

It is noted that, although the man of the art can analyze the various layers in a manufactured camouflage according to the invention, the needling will mix the layers such that they no longer present any clear inner delimitations.

I claim:

1. A camouflage covering for covering military equipment comprising several layers as counted from a bottom side to an outer surface; a strength layer, an aluminized plastic film, a layer comprising fibers of a super-absorbent matter, and a surface layer, wherein said layers are needled together and said surface layer has a pile configuration.

2. A camouflage covering according to claim 1, wherein the pile configuration is a pig's bristle Dilo-needling pile.

3. A camouflage covering according to claim 1, wherein said fibers of super-absorbent matter include both hydrophilic fibers and hydrophobic fibers.

4. A camouflage covering according to claim 3, wherein the said hydrophilic fibers comprise rayon fibers.

5. A camouflage covering according to claim 1 wherein said fibers of super-absorbent matter also comprise electrically conducting fibers.

6. A camouflage covering according to claim 1, wherein some but not all of said fibers of super-absorbent matter have a lower melting-point than other fibers included in the covering and that at least some of said lower melting-point fibers are heat-deformed and participate in holding together the covering by their permanently deformed forms.

* * * * *